US010464768B2

(12) United States Patent
Sato

(10) Patent No.: US 10,464,768 B2
(45) Date of Patent: Nov. 5, 2019

(54) CONVEYING APPARATUS

(71) Applicant: Oki Data Corporation, Tokyo (JP)

(72) Inventor: Daichi Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 115 days.

(21) Appl. No.: 15/882,208

(22) Filed: Jan. 29, 2018

(65) Prior Publication Data

US 2018/0215568 A1 Aug. 2, 2018

(30) Foreign Application Priority Data

Jan. 30, 2017 (JP) ..... 2017-014520

(51) Int. Cl.
*B65H 20/02* (2006.01)
*B65H 23/188* (2006.01)
*B65H 23/10* (2006.01)

(52) U.S. Cl.
CPC ..... *B65H 23/1888* (2013.01); *B65H 20/02* (2013.01); *B65H 23/10* (2013.01); *B65H 2404/14* (2013.01)

(58) Field of Classification Search
CPC .... B65H 23/10; B65H 23/24; B65H 23/1888; B65H 20/02
See application file for complete search history.

(56) References Cited

U.S. PATENT DOCUMENTS 5,472,127 A * 12/1995 Ichii ..... B65H 23/1888 226/118.3
2016/0311638 A1* 10/2016 Minato ..... B65H 23/1888
2017/0275119 A1* 9/2017 Hamano ..... B41J 2/01
2018/0022563 A1* 1/2018 Liang ..... B65H 23/1888 242/419.1
2018/0088509 A1* 3/2018 Musete ..... B41J 15/042
2018/0170704 A1* 6/2018 Yagi ..... B65H 23/0208
2018/0215179 A1* 8/2018 Akahane ..... B65H 23/1955

FOREIGN PATENT DOCUMENTS

JP 2002-234648 A 8/2002

* cited by examiner

*Primary Examiner* — Sang K Kim
(74) *Attorney, Agent, or Firm* — Metrolex IP Law Group, PLLC

(57) ABSTRACT

A conveying apparatus according to an embodiment includes: a feeding-out member movable along a shaft member extending in a first direction and rotatable in a medium conveyance direction; a conveyance member configured to convey the medium from the feeding-out member along a medium conveyance route; a load applying member that applies a load in a direction opposed to the medium conveyance direction; a guide member placed at one end portion of the medium conveyance route in the first direction, and configured to restrict movement of the medium in the first direction; and an inclination member inclined with respect to the first direction and in contact with the medium between the feeding-out member and the conveyance member in the medium conveyance route, thereby making a conveyed distance of the medium shorter at a first side near the guide member than at a second side far from the guide member.

7 Claims, 13 Drawing Sheets

CONVEYING APPARATUS

CROSS REFERENCE TO RELATED APPLICATIONS

This application claims priority based on 35 USC 119 from prior Japanese Patent Application No. 2017-014520 filed on Jan. 30, 2017, entitled "CONVEYING APPARATUS", the entire contents of which are incorporated herein by reference.

BACKGROUND

The present disclosure relates to a conveying apparatus that conveys a medium while unwinding a roll of medium.

A conveying apparatus that conveys a medium while unwinding a roll of medium is used in a variety of fields. This type of conveying apparatus supplies a medium to external apparatuses that vary depending on intended uses.

Various ideas have been proposed about the configuration of the conveying apparatus. One specific example is use of a tension sensor or the like in order to correct skew running, meandering running and the like of the medium (for example, see Japanese Unexamined Patent Application Publication No. 2002-234648).

SUMMARY

Specific examinations have been made in order to improve the conveying performance of the conveying apparatus, but measures for the improvement are still insufficient. There remains room for the improvement.

One embodiment of the present disclosure is to provide a conveying apparatus that can obtain excellent conveying performance.

An aspect is a conveying apparatus that includes: a shaft member extending in a first direction and rotatable about a rotation axis parallel with the first direction; a feeding-out member slidably supported on the shaft member in the first direction and retaining a roll of medium, and configured to rotate in a medium conveyance direction with rotation of the shaft member while being movable in the first direction along the shaft member; a conveyance member configured to convey the medium by drawing out the medium from the feeding-out member along a medium conveyance route; a load applying member that applies a load on the feeding-out member in a direction opposed to the medium conveyance direction; a guide member provided between the feeding-out member and the conveyance member in the second direction and at one end portion of the medium conveyance route in the first direction, and configured to restrict movement of the medium in the first direction; and an inclination member inclined with respect to the first direction and in contact with the medium between the feeding-out member and the conveyance member in the medium conveyance route, thereby making a conveyed distance of the medium shorter at a first side of the medium conveyance route near the guide member than at a second side of the medium conveyance route far from the guide member.

According to the aspect, the feeding-out member rotates about the shaft member with the applied load while moving along the shaft member. Thus, excellent conveying performance can be obtained.

DETAILED DESCRIPTION OF EMBODIMENTS

Figure 1:
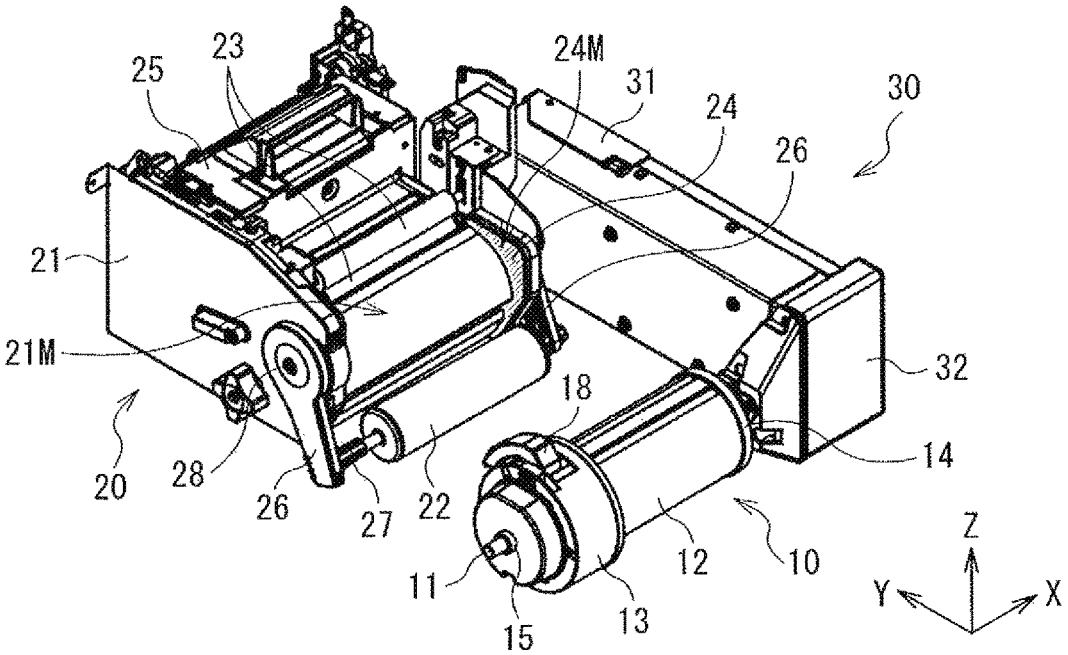
FIG. 1 is a perspective view illustrating a configuration of a conveying apparatus according to one or more embodiments.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiments are described in the following sequence.

1. Conveying Apparatus
1-1. Overall Configuration
1-2. Configuration of Conveying Unit
1-3. Configuration of Support Unit
1-4. Configuration of Feeding-out Unit
1-5. How Conveying Apparatus Works
1-6. Operation and Effects
2. Modified Examples

1. Conveying Apparatus

Descriptions are provided for a conveying apparatus according to one or more embodiments.

The conveying apparatus discussed herein is a conveying apparatus that uses a roll of medium (hereinafter referred to as a "roll") and continuously conveys the medium while unwinding the roll of medium.

The intended use of the conveying apparatus is not limited to a particular one. This conveying apparatus is used to supply a medium to an external apparatus such as an image forming apparatus (a so-called printer).

It should be noted that the material of the medium is not limited to a particular one, but for example is one or more of paper, film, laminated paper, laminated film and the like. This medium may be a laminate including one or more types of paper, a laminate including one or more types of films, or a laminate including one or more types of paper and one or more types of films.

(1-1. Overall Configuration)

First of all, descriptions are provided for an overall configuration of the conveying apparatus.

FIG. 1 illustrates a perspective configuration of the conveying apparatus. Incidentally, FIG. 1 illustrates the configuration of the conveying apparatus with no roll R (see FIG. 14) attached to the conveying apparatus. This roll R is a roll of medium M.

As illustrated in FIG. 1, the conveying apparatus includes, for example, a feeding-out unit 10, a conveying unit 20, and a support unit 30.

The feeding-out unit 10 mainly retains the roll R, and continuously feeds out the medium M from the roll R to the conveying unit 20.

A direction (Y-axis direction) in which the medium M is conveyed from the feeding-out unit 10 and the conveying unit 20 is hereinafter referred to as a "conveyance direction." A direction (X-axis direction) that intersects the conveyance direction, in other words, a direction defined by the width of the medium M, will be hereinafter referred to as a "width direction."

It should be noted that in the embodiment, the conveyance direction is a "second direction," and the width direction is a "first direction."

The conveying unit 20 mainly conveys the medium M fed out from the feeding-out unit 10, and delivers the medium M to the outside. Thereby, the medium M conveyed by the conveying apparatus is supplied to, for example, the above-mentioned external apparatus such as the image forming apparatus.

The support unit 30 mainly supports the feeding-out unit 10, and drives the feeding-out unit 10. The support unit 30 includes, for example, a support plate 31, and a support lid 32 attached to the support plate 31.

It should be noted that the support unit 30 extends in the conveyance direction, for example. The feeding-out unit 10 is placed, for example, at a location near one end portion of the support unit 30, and is drivably supported by the one end portion of the support unit 30.

The configurations of the feeding-out unit 10, the conveying unit 20 and the support unit 30 are described later (see FIGS. 2 to 13).

(1-2. Configuration of Conveying Unit)

Next, descriptions are provided for the configuration of the conveying unit 20. In the following descriptions, FIG. 1 is referred to whenever deemed necessary.

Figure 2:
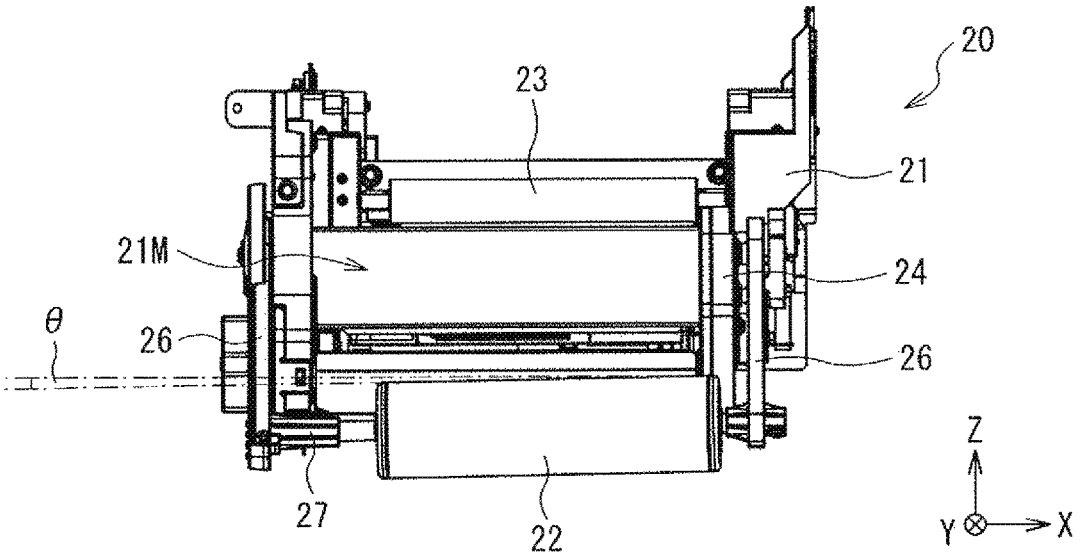
FIG. 2 is a plan (front) view of a conveying unit in the conveying apparatus illustrates in FIG. 1.
Figure 3:
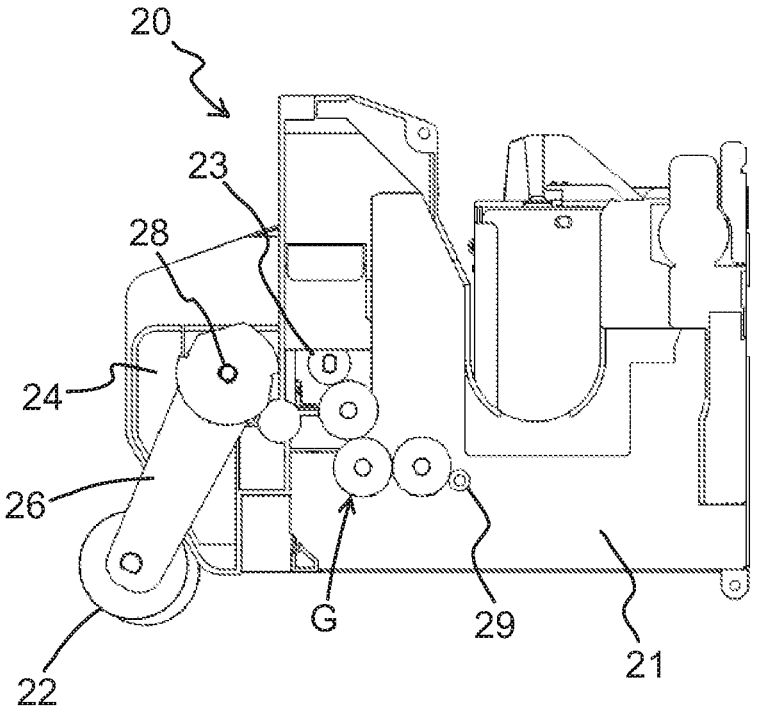
FIG. 3 is a plan (side) view of the conveying unit in the conveying apparatus illustrates in FIG. 1.
Figure 4:
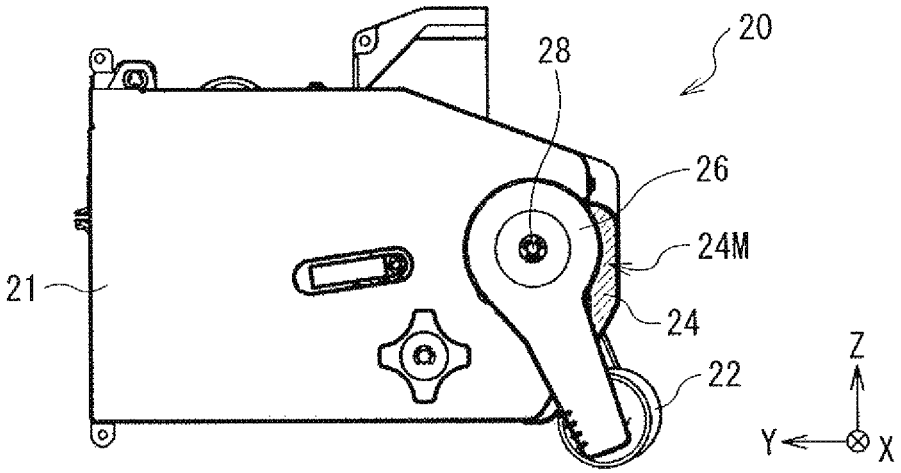
FIG. 4 is a plan (side) view of the conveying unit in the conveying apparatus illustrates in FIG. 1.

FIG. 2 illustrates a plan (front) configuration of the conveying unit 20 illustrated in FIG. 1. FIG. 4 illustrates a plan (side) configuration of the conveying unit 20 illustrated in FIG. 1.

As illustrated in FIGS. 1 to 4, the conveying unit 20 includes, for example, a conveyance main body 21, a steering roller 22, a feed roller 23, a side guide 24 and a cutter 25.

It should be noted that the steering roller 22, the feed roller 23 and the side guide 24 correspond respectively to an "inclination member," a "conveyance member," and a "guide member" of the present disclosure.

The conveyance main body 21 is mainly a base that supports the steering roller 22, the feed roller 23, the side guide 24, the cutter 25 and the like.

The conveyance main body 21 includes a conveyance surface 21M, for example, in the middle of a conveyance route of the medium M, more specifically, between the steering roller 22 and the feed roller 23. The conveyance surface 21M guides the medium M from the steering roller 22 to the feed roller 23. The condition of the conveyance surface 21M is not limited to a particular one, and may be a flat surface, curved surface, or a surface including both a flat surface and a curved surface. FIG. 1 illustrates the conveyance surface 21M that is, for example, a curved-out surface.

The steering roller 22 mainly adjusts tensile forces on the medium M while conveying the medium M.

The steering roller 22 is placed on the conveyance route of the medium M fed out from the feeding-out unit 10. In other words, the steering roller 22 is placed between the feeding-out unit 10 and the feed roller 23, more specifically, between the feeding-out unit 10 and the side guide 24.

Furthermore, the steering roller 22 extends, for example, in the width direction (X-axis direction), and is rotatable around the X axis.

A height-direction (Z-axis-direction) location of the steering roller 22 is not limited to a particular one. In this embodiment, the steering roller 22 is placed, for example, in a location lower than the side guide 24.

It should be noted that out of a below-described series of components included in the conveying apparatus, components including the word "roller" in their names extend in the width direction (X-axis direction), and are rotatable around the X axis, like the steering roller 22.

For example, a shaft 27 is supported by a pair of arms 26, and is penetrated through the steering roller 22. The pair of arms 26, for example, are placed facing each other with the conveyance route of the medium M interposed in between. Like the steering roller 22, the shaft 27 extends in the width direction, for example. Thus, the steering roller 22 is rotatable, for example, around the shaft 27.

It should be noted that the shaft 27 is supported, for example, by end portions of the pair of arms 26. The other end portions of the pair of arms 26 are turnably (swingably) supported, for example, by the shaft 28 inserted through the conveyance main body 21. Thus, the steering roller 22 is movable vertically in the height direction (Z-axis direction), for example, using the turn action of the pair of arms 26. Accordingly, while the medium M is being conveyed, the tensile forces on the medium M are adjusted using the vertical movement of the steering roller 22.

Particularly, the steering roller 22 inclines as illustrated in FIG. 2. That is to say, the extending direction of the steering roller 22 inclines to the horizontal direction (X axis).

To put it specifically, the steering roller 22 inclines such that: the conveyed distance of the medium M becomes shorter toward a first widthwise side of the conveyance route of the medium M, that is to say, a first side of the conveyance route near the side guide 24 (the right in FIG. 2); and the conveyed distance of the medium M becomes longer toward a second widthwise end of the conveyance route, that is to say, a second side of the conveyance route far from the side guide 24 (the left in FIG. 2).

In other words, for example, in the case where the steering roller 22 is placed at the location lower than the side guide 24, the steering roller 22 inclines such that the steering roller 22 becomes higher toward the first side of the conveyance route near the side guide 24; and the steering roller 22 becomes lower toward the second side of the conveyance route far from the side guide 24.

An inclination angle θ of the steering roller 22 is not limited to a particular one, but is, for example, within a range of approximately 0.1 degrees to approximately 0.5 degrees. This inclination angle θ is defined by the extending direction of the steering roller 22 and the horizontal direction (X-axis direction).

The reason for the inclination of the steering roller 22 is that: a tensile force generated on the medium M on the first side near the side guide 24 and a tensile force generated on the medium M on the second side far from the side guide 24 are deliberately made different from each other; and using the difference in the tensile force, the medium M is guided in a direction closer to the side guide 24 while the medium M is being conveyed. The principle for the guiding of the medium M in the direction closer to the side guide 24 is discussed later (see FIGS. 15 and 16).

The feed roller 23 mainly conveys the medium M fed out from the feeding-out unit 10. Particularly, the feed roller 23 grips the medium M conveyed via the steering roller 22, and supplies the medium M to the cutter 25.

The feed roller 23 is placed downstream of the steering roller 22 in the conveyance direction. To put it more specifically, the feed roller 23 is placed downstream of the side guide 24.

A height-direction (Z-axis-direction) location of the feed roller 23 is not limited to a particular one. In this case, the feed roller 23 is placed, for example, at a location higher than the steering roller 22.

The feed roller 23 includes a pair of rollers placed with the medium M interposed in between, in order to grip the medium M. The feed roller 23 is rotated by driving force (rotation force) of a motor 29 via gears G.

The side guide 24 mainly restricts movement of the medium M in the width direction.

The side guide 24 is placed between the feeding-out unit 10 and the feed roller 23. To put it more specifically, the side guide 24 is placed between the steering roller 22 and the feed roller 23.

Furthermore, the side guide 24 is placed at one widthwise side of the conveyance route of the medium M. The location of the side guide 24 is not limited to a particular one, as long as the location is at the one widthwise side of the conveyance route of the medium M. In this case, the side guide 24 is placed, for example, at the right of the conveyance route of the medium M (near the support unit 30).

The three-dimensional shape of the side guide 24 is not limited to a particular one, as long as the shape enables the side guide 24 to restrict the movement of the medium M in the width direction. In this case, the three-dimensional shape of the side guide 24 is, for example, a substantially plate shape that includes a guide surface 24M extending in the conveyance direction.

The cutter 25 mainly cuts the medium M supplied from the feed roller 23. Thereby, the belt-shaped medium M continuously fed out from the roll R is cut into sheets.

The cutter 25 is placed, for example, downstream of the feed roller 23 in the conveyance direction. Furthermore, the cutter 25 includes, for example, a cutter blade that cuts the medium M.

(1-3. Configuration of Support Unit)

Next, the configuration of the support unit 30 is described. In the following descriptions, FIG. 1 is referred to whenever deemed necessary.

Figure 5:
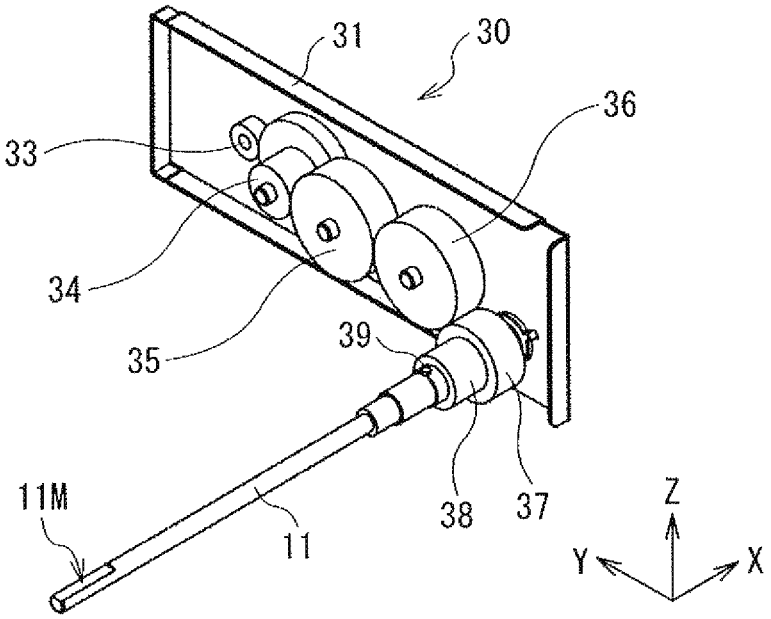
FIG. 5 is a perspective view of a support unit in the conveying apparatus illustrates in FIG. 1.

FIG. 5 illustrates a perspective configuration of the support unit 30 illustrated in FIG. 1. Incidentally, FIG. 5 illustrates the configuration of the support unit 30 (the support plate 31 and the support lid 32) with the support lid 32 removed from the support unit 30. FIG. 5 further illustrates a part (a driving shaft 11) of the feeding-out unit 10 for the purpose of making a connecting relationship between the feeding-out unit 10 and the support unit 30 easy to understand.

As illustrated in FIG. 5, the support unit 30 includes, for example, a motor gear 33, a deceleration gear 34, idle gears 35, 36, a driving gear 37, and a torque limiter 38. The motor gear 33, the deceleration gear 34, the idle gears 35, 36 and the driving gear 37 are rotatably supported, for example, by the support plate 31.

The motor gear 33, the deceleration gear 34, the idle gears 35, 36 and the driving gear 37 are arranged in this order, for example. The driving gear 37 is rotatable, for example, using driving force (rotation force) of the motor gear 33 via the deceleration gear 34 and the idle gears 35, 36.

The driving gear 37 mainly rotates the driving shaft 11. Thereby, the driving shaft 11 is rotatable, for example, in response to the rotation of the driving gear 37.

The torque limiter 38, serving as a load applying member, mainly gives torque (load) to the rotation of the driving shaft 11. The torque limiter 38 is attached, for example, to the driving gear 37. One end portion of the driving shaft 11 is fixed, for example, to the torque limiter 38 using a fixing pin 39.

(1-4. Configuration of Feeding-Out Unit)

Next, descriptions are provided for the configuration of the feeding-out unit 10. In the following descriptions, FIGS. 1 and 5 are referred to whenever deemed necessary.

Figure 6:
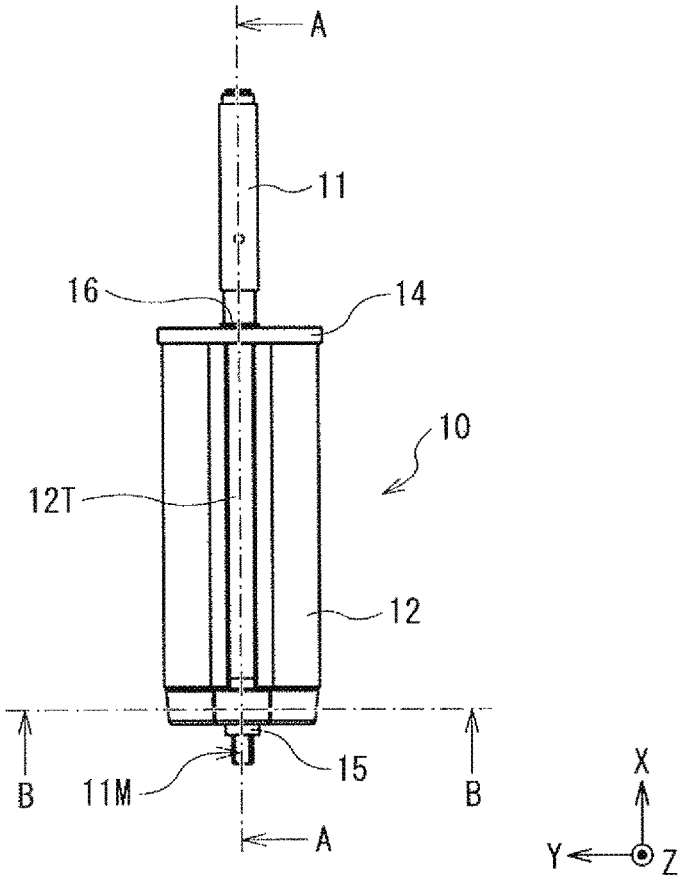
FIG. 6 is a plan (top) view of a feeding-out unit in the conveying apparatus illustrates in FIG. 1.
Figure 7:
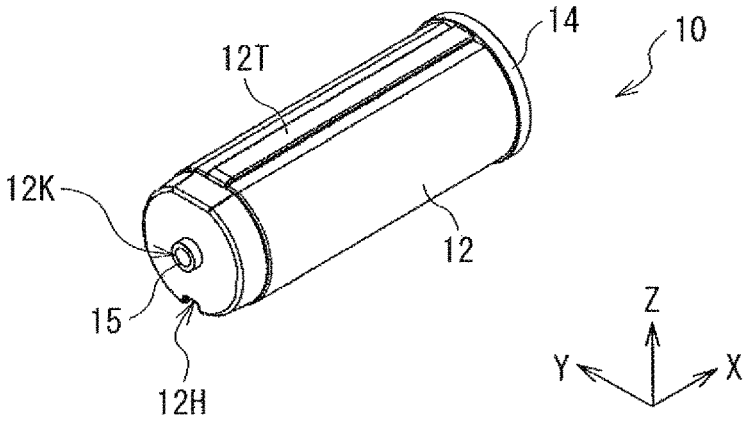
FIG. 7 is a perspective view of a feeding-out core in the feeding-out unit illustrates in FIG. 6.
Figure 8:
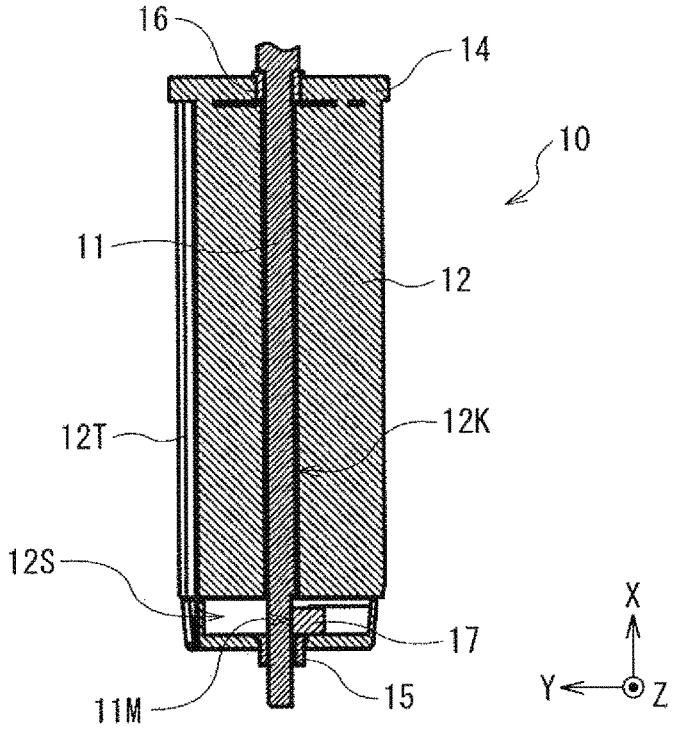
FIG. 8 is a cross-sectional view of the feeding-out unit taken along the A-A line in FIG. 6.
Figure 9:
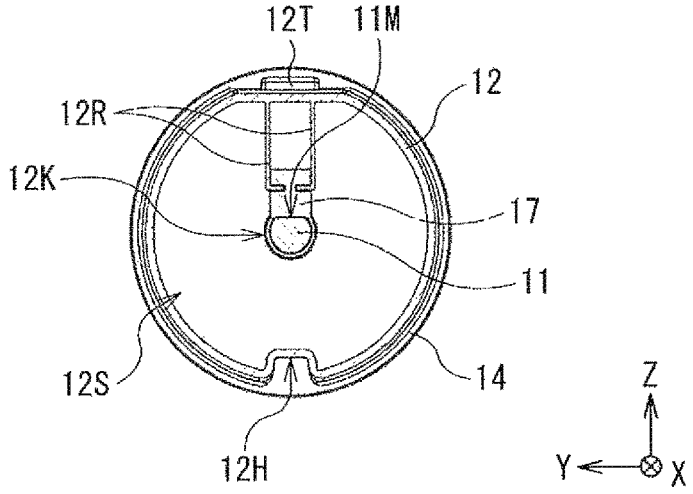
FIG. 9 is a cross-sectional view of the feeding-out unit taken along the B-B line in FIG. 6.

FIG. 6 illustrates a plan (top) configuration of the feeding-out unit 10 illustrated in FIG. 1. FIG. 7 illustrates a perspective configuration of a feeding-out core 12 (also referred to as a "roll core 12") illustrated in FIG. 6. FIG. 8 illustrates a cross-sectional configuration of the feeding-out unit 10 taken along the A-A line in the FIG. 6. FIG. 9 illustrates a cross-sectional configuration of the feeding-out unit 10 taken along the B-B line in the FIG. 6. Incidentally, FIGS. 6, 8 and 9 illustrate the configuration of the feeding-out unit 10 with a cap 13 removed from the feeding-out unit 10 as illustrated in FIG. 1.

Figure 10:
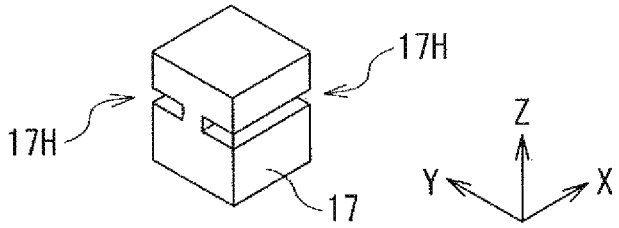
FIG. 10 is a perspective view of a friction member in the conveying apparatus illustrates in FIG. 1.
Figure 11:
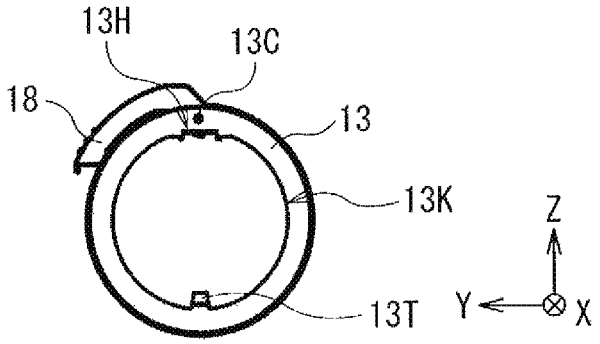
FIG. 11 is a plan (front) view of a cap in the conveying apparatus illustrates in FIG. 1.
Figure 12:
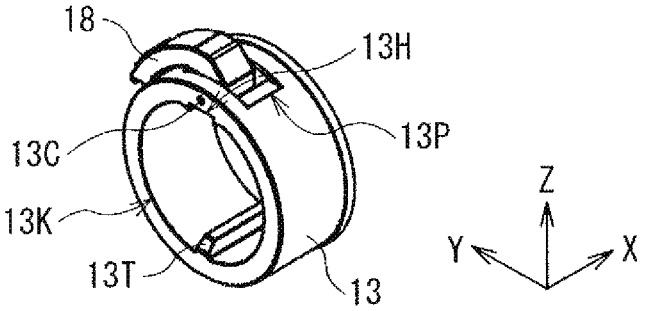
FIG. 12 is a perspective view of the cap in the conveying apparatus illustrates in FIG. 1.
Figure 13:
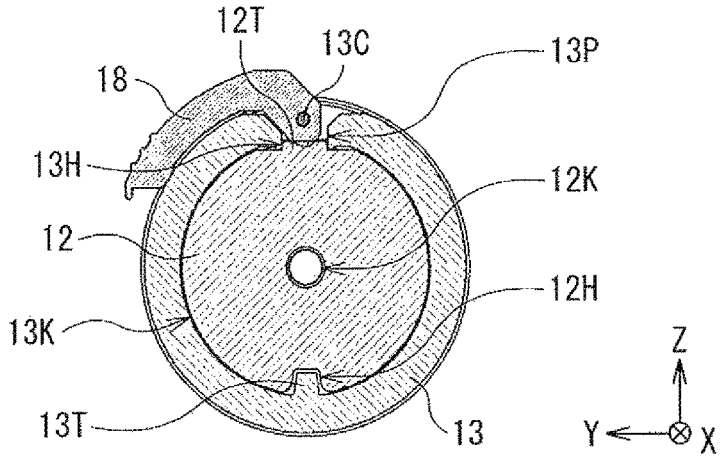
FIG. 13 is a cross-sectional view of the feeding-out unit in the conveying apparatus illustrates in FIG. 1.

FIG. 10 illustrates a perspective configuration of a friction member 17. FIGS. 11 and 12 each illustrate a configuration of the cap 13 illustrated in FIG. 1. FIG. 11 illustrates a plan (front) configuration of the cap 13, and FIG. 12 illustrates a perspective configuration of the cap 13. FIG. 13 is a cross-sectional configuration of the feeding-out unit 10 illustrated in FIG. 1. Incidentally, FIG. 13 illustrates a cross section of a part of the feeding-out unit 10 where the cap 13 is attached to the feeding-out core 12, and omits the illustration of the driving shaft 11.

As illustrated in FIGS. 1 and 5 to 13, the feeding-out unit 10 includes, for example, the driving shaft 11, the feeding-out core 12, the cap 13, a flange 14, slide bushes 15, 16 and the friction member 17.

It should be noted that the driving shaft 11 and the feeding-out core 12 correspond respectively to a "shaft member" and a "feeding-out member" of the present disclosure.

The driving shaft 11 mainly rotates using driving force (rotation force) of the support unit 30 (the driving gear 37), and thereby rotates the feeding-out core 12.

As illustrated in FIGS. 5, 6 and 8, for example, the driving shaft 11 is a shaft extending in the width direction (the X-axis direction), and is rotatable around the X axis. In other words, the driving shaft 11 is rotatable in a direction (the conveyance direction and the Y-axis direction) that intersects a direction (the width direction and the X-axis direction) in which the driving shaft 11 itself extends. Furthermore, the driving shaft 11 is inserted, for example, through a bearing portion 12K provided to the feeding-out core 12. Thereby, the feeding-out core 12 is rotatable in response to the rotation of the driving shaft 11. One end portion of the driving shaft 11 is, for example, connected to the driving gear 37 via the torque limiter 38, as discussed above. The other end portion of the driving shaft 11, for example, juts out from the feeding-out core 12.

The other end portion and its neighborhood of the driving shaft 11 is provided, for example, with a flat surface 11M extending in the conveyance direction.

The reason why the driving shaft 11 is provided with the flat surface 11M is that: the flat surface 11M increases friction force produced between the contact surface of the driving shaft 11 and the contact surface of the friction member 17; and the use of the friction member 17 (the friction force) makes it easier to restrict the movement of the feeding-out core 12. The principle for why the use of the friction member 17 makes it easier to restrict the movement of the feeding-out core 12 is discussed later (see FIGS. 15 to 18).

The feeding-out core 12 mainly retains the roll R. Particularly, the feeding-out core 12 continuously feeds out the medium M to the conveying unit 20 by rotating in response to the rotation of the driving shaft 11 while retaining the roll R.

As illustrated in FIGS. 6 to 8, for example, the feeding-out core 12 is a substantially cylindrical member that extends in the same direction as the driving shaft 11 extends, that is to say, in the width direction.

The feeding-out core 12 is provided, for example, with a protrusion 12T that extends in the same direction as the feeding-out core 12 extends. The feeding-out core 12 is further provided, for example, with a recessed portion 12H that extends in the same direction as the feeding-out core 12 extends. The location of the protrusion 12T is not limited to a particular one, and the location of the recessed portion 12H is also not limited to a particular one. FIGS. 7, 9, 13 and the like illustrate the recessed portion 12H and the protrusion 12T that are provided to the opposite sides of the feeding-out core 12.

Particularly, the feeding-out core 12 is movable along the driving shaft 11 depending on the necessity. In other words, the feeding-out core 12 is slidable over the driving shaft 11 in the width direction.

In this case, the feeding-out core 12 is movable, for example, from the first widthwise side of the conveyance route, that is to say, the first side of the conveyance route near the side guide 24 (the right in FIG. 1), toward the second widthwise side of the conveyance route, that is to say, the second side of the conveyance route far from the side guide 24 (the left in FIG. 1). It is a matter of course that the feeding-out core 12 is also movable from the second side of the conveyance route far from the side guide 24 (the second widthwise side) toward the first side of the conveyance route near the side guide 24 (the first widthwise side).

The cap 13 mainly fixes the roll R held by the feeding-out core 12.

As illustrated in FIGS. 11 to 13, the cap 13 is, for example, a ring-shaped member that has an opening 13K.

The inner wall surface of the opening 13K is provided, for example, with a protrusion 13T and a recessed portion 13H. The location of the protrusion 13T corresponds, for example, to the location of the recessed portion 12H provided to the feeding-out core 12, and the location of the recessed portion 13H corresponds, for example, to the location of the protrusion 12T provided to the feeding-out core 12.

For example, a lock lever 18 that fixes the cap 13 to the feeding-out core 12 is attached to the cap 13. One end portion of the lock lever 18 is rotatable, for example, around a shaft 13C inserted through the cap 13. Thereby, the lock lever 18 is turnable around the shaft 13C. Incidentally, the cap 13 is provided, for example, with an introduction port 13P. The one end portion of the lock lever 18 can be introduced into the opening 13K via the introduction port 13P.

As illustrated in FIG. 13, one end portion of the feeding-out core 12 is inserted, for example, into the opening 13K provided to the cap 13. In this case, the cap 13 is aligned to the feeding-out core 12 by: fitting the protrusion 13T into the recessed portion 12H; and fitting the protrusion 12T into the recessed portion 13H. Furthermore, the one end portion of the lock lever 18 is pressed against the feeding-out core 12 (the protrusion 12T) through the introduction port 13P. Thus, the cap 13 is fixed to the feeding-out core 12. This makes the cap 13 less likely to come off the feeding-out 12.

The flange 14 mainly restricts the position of the roll R held by the feeding-out core 12.

The flange 14 is, for example, a ring-shaped protrusion provided to the other end portion of the feeding-out core 12. The "other end portion" of the feeding-out core 12 is an end portion of the feeding-out core 12 opposite from the end portion of the feeding-out core 12 to which the cap 13 is provided.

The slide bushes 15, 16 are devices that, mainly, enables the feeding-out core 12 to smoothly slide over the driving shaft 11 using rolling motion of balls therein.

As illustrated in FIGS. 1 and 6 to 8, the slide bush 15 is attached, for example, to an end portion of the feeding-out core 12 to which the cap 13 is attached. The driving shaft 11 is inserted, for example, through the slide bush 15.

As illustrated in FIGS. 6 and 8, the slide bush 16 is attached, for example, to an end portion of the feeding-out core 12 to which the flange 14 is provided. The driving shaft 11 is inserted, for example, through the slide bush 16.

The friction member 17 mainly restricts movement of the feeding-out core 12 along the driving shaft 11 using friction force.

The friction member 17 is fixed to the feeding-out core 12, and is pressed against the driving shaft 11. Thereby, the friction force is produced between the contact surface of the driving shaft 11 and the contact surface of the friction member 17. Using the friction force, the friction member 17 restricts the movement of the feeding-out core 12.

Furthermore, the friction member 17 includes one or more of materials (high friction materials) that can produce large friction force between the above-mentioned contact surfaces. Types of high friction materials are not limited to particular ones. Examples of the high friction materials include various rubbers that have elastic deformation properties.

In this respect, the three-dimensional shape of the friction member 17 is not limited to a particular one, as long as the shape enables the friction member 17 to be fixed to the feeding-out member 12. In this case, the three-dimensional shape of the friction member 17 is, for example, substantially a cube that includes two recessed portions 17H, as illustrated in FIG. 10. One recessed portion 17H is provided, for example, to one surface of the friction member 17, while the other recessed portion 17H is provided, for example, to another surface of the friction member 17 that is opposite from the one surface. Incidentally, each of the two recessed portions 17H is provided, for example, dividing the corresponding surface of the friction member 17 into two parts.

In addition, a fixing mechanism that fixes the friction member 17 to the feeding-out core 12 is not limited to a particular one, as long as the mechanism enables the friction member 17 to be fixed to the feeding-out core 12. In this case, as illustrated in FIGS. 8 and 9, for example, an inside of the feeding-out core 12 that is near the slide bush 15 is provided with a space 12S, and a pair of ribs 12R are placed in the space 12S. The pair of the ribs 12R, for example, stick out from the outer circumferential portion of the feeding-out core 12 toward the bearing portion12K while facing each other, and bend near their distal ends in a way that they become closer to each other.

The distal end portions of the pair of the ribs 12R are, for example, fitted into the pair of recessed portions 17H provided to the friction member 17. Thereby, the friction member 17 is fixed to the feeding-out core 12 (the pair of the ribs 12R).

Particularly, in the state of, for example, being fixed to the feeding-out core 12 with the assistance of the pair of ribs 12R, the friction member 17 is pressed against the flat surface 11M provided to the driving shaft 11. In this respect, for example, for the purpose of making the feeding-out core 12 movable along the driving shaft 11 with the friction member 17 pressed against the flat surface 11M, the friction member 17 is pressed against a part of the flat surface 11M. In this case, for example, in the state of being contractingly deformed because of being pressed against the part of the flat surface 11M, the friction member 17 is held by the pair of ribs 12. Thereby, the friction member 17 is pressed against the flat surface 11M, for example, using the resilience (elastic force) of the friction member 17 itself. Thus, large friction force can be produced between the contact surface of the driving shaft 11 (the flat surface 11M) and the contact surface of the friction member 17.

(1-5. How Conveying Apparatus Works)

Next, descriptions are provided for how the conveying apparatus works. In the following descriptions, FIGS. 1 to 12 are referred to whenever deemed necessary.

To begin with, descriptions are provided for the conveyance operation of the conveying apparatus. Thereafter, descriptions are provided for the moving operation of the feeding-out core 12 that is a feature of the conveying apparatus.

Figure 14:
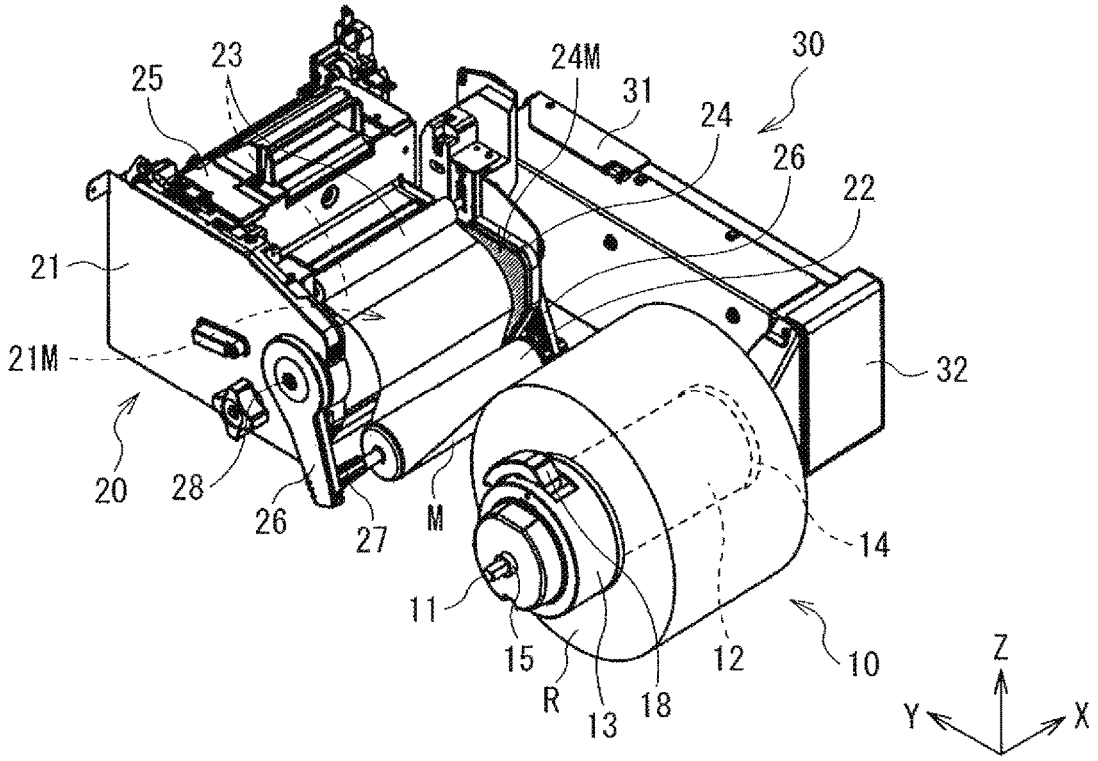
FIG. 14 is a perspective view of the conveying apparatus for the purpose of explaining how the conveying apparatus illustrates in FIG. 1 works.

FIG. 14 corresponds to FIG. 1, and illustrates a perspective configuration of the conveying apparatus for the purpose of explaining how the conveying apparatus works.

Figure 15:
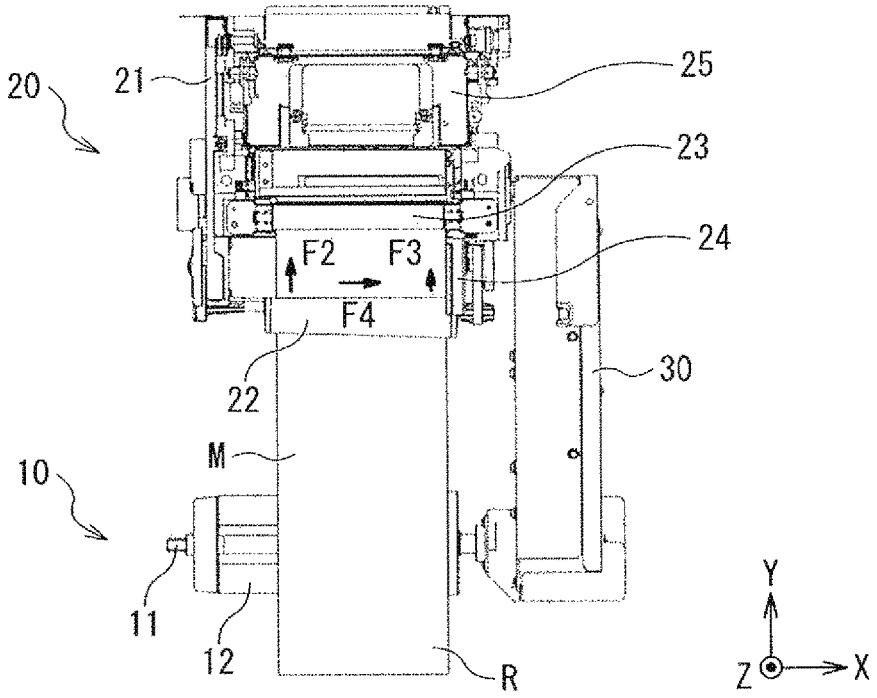
FIG. 15 is a plan (top) view of the conveying apparatus in operation for the purpose of explaining how tensile forces are generated while the conveying apparatus is in operation in a case where the outer diameter of the roll R is large.
Figure 16:
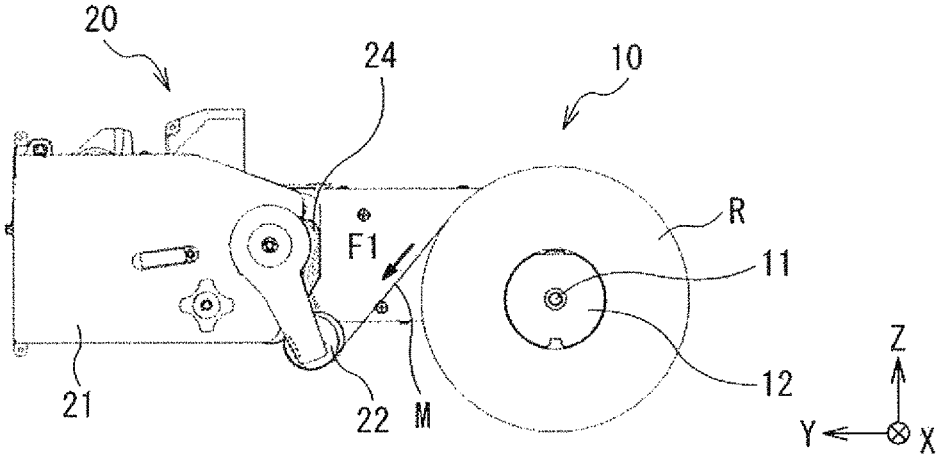
FIG. 16 is a plan (side) view of the conveying apparatus illustrated in FIG. 15.

FIG. 15 illustrates a plan (top) configuration of the conveying apparatus for the purpose of explaining how tensile forces are generated while the conveying apparatus is in operation (in a case where the outer diameter of the roll R is large). FIG. 16 illustrates a plan (side) configuration of the conveying apparatus illustrated in FIG. 14.

Figure 17:
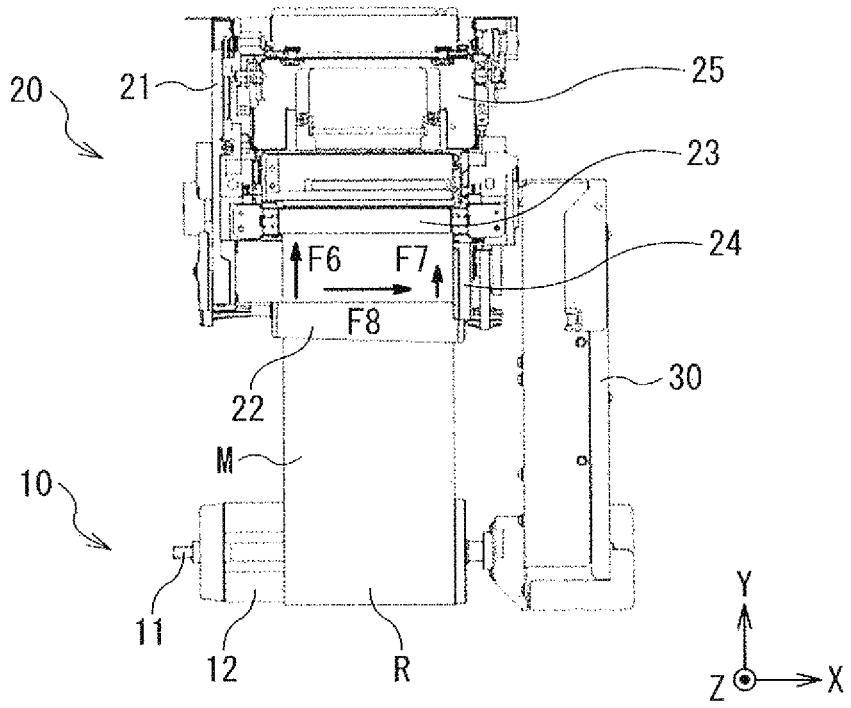
FIG. 17 is a plan (top) view of the conveying apparatus in operation for the purpose of explaining how tensile forces are generated while the conveying apparatus is in operation in a case where the outer diameter of the roll R is small.
Figure 18:
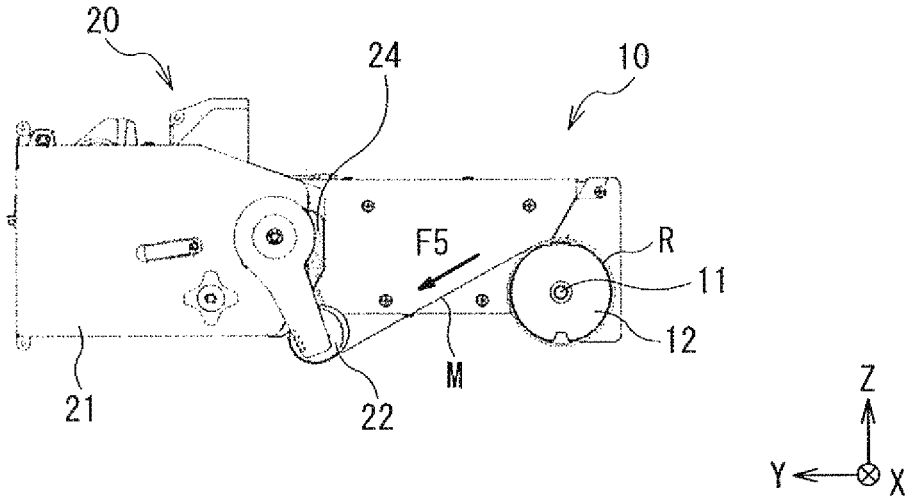
FIG. 18 is a plan (side) view of the conveying apparatus illustrated in FIG. 17.

FIG. 17 illustrates a plan (top) configuration of the conveying apparatus for the purpose of explaining how tensile forces are generated while the conveying apparatus is in operation (in a case where the outer diameter of the roll R is small), and corresponds to FIG. 14. FIG. 18 illustrates a plan (side) configuration of the conveying apparatus illustrated in FIG. 16, and corresponds to FIG. 16.

(Conveyance Operation of Conveying Apparatus)

Before the use of the conveying apparatus, as a preparation, for example, the roll R is attached to the feeding-out unit 10, as illustrated in FIG. 16. In this case, the attached state of the roll R is set, for example, to put the medium M in a so-called feed-from-top condition. The "feed-from-top condition" is a condition in which the medium M is fed out from the top of the roll R.

To put it specifically, after the cap 13 is detached from the feeding-out core 12, the roll R is brought into the flange 14, and the feeding-out core 12 is inserted through the roll R until one end portion of the feeding-out core 12 sticks out from the roll R. Thereby, the roll R is held by the feeding-out core 12.

Subsequently, the sticking-out portion of the feeding-out core 12 is inserted into the opening 13K provided to the cap 13. Thereafter, the lock lever 18 is turned around the shaft 13. Thereby, the cap 13 is fixed to the feeding-out core 12 using the lock lever 18.

In this case, the cap 13 is aligned to the feeding-out core 12 by: fitting the protrusion 13T into the recessed portion 12H; and fitting the protrusion 12T into the recessed portion 13H. As illustrated in FIGS. 14 and 16, the setting of the medium M is completed in a state where the leading edge of the medium M is hold by the feed roller 23 with the medium M passing under the steering roller 22.

In the conveyance operation of the conveying apparatus, in the support unit 30, the driving gear 37 rotates using the motor gear 33, the deceleration gear 34 and the idle gears 35, 36. Thus, in the feeding-out unit 10, the driving shaft 11 rotates via the torque limiter 38.

In the conveying unit 20, the motor 29 also rotates the feed roller 23 using the gears G in the conveyance direction of the medium M.

While the medium M is being conveyed along the conveyance surface 21M, the medium M is guided in the direction closer to the side guide 24. Thus, the movement of the medium M in the width direction is restricted by the side guide 24. Thereby, skew running, meandering running and the like of the medium M is inhibited.

The principle for why the medium M is guided in the direction closer to the side guide 24 is as follows. While the medium M fed out from the feeding-out unit 10 is being conveyed in the conveying unit 20, tensile forces on the medium M differs from each other, for example, due to the inclination of the steering roller 22 that is placed on the conveyance route of the medium M, as illustrated in FIGS. 15 and 16.

To put it specifically, as discussed above, the steering roller 22 inclines such that the steering roller 22 is lower on the second side of the conveyance route far from the side guide 24 (at the second widthwise side of the conveyance route) than on the first side of the conveyance route near the side guide 24 (at the first widthwise side of the conveyance route). For this reason, the conveyed distance of the medium M is longer along the second side of the conveyance route far from the side guide 24 (the second widthwise side of the conveyance route) than along the first side of the conveyance route near the side guide 24 (the first widthwise side of the conveyance route).

In this case, the steering roller 22 is pressed by the medium M more strongly on the second side far from the side guide 24 than on the first side near the side guide 24. For this reason, a tensile force F2 on the medium M on the second side far from the side guide 24 is larger than a tensile force F3 on the medium M on the first side near the side guide 24. Due to the difference between the tensile forces F2, F3, the medium M moves closer to the side guide 24 while conveyed along the conveyance surface 21M. Thus, the medium M is guided in the direction closer to the side guide 24.

Since the medium M is guided in the direction closer to the side guide 24, the medium M comes into contact with the guide surface 24M of the side guide 24. After the medium M comes into contact with the side guide 24, the medium M cannot move in the width direction any more. Thus, the movement of the medium M in the width direction is stopped by the side guide 24.

As discussed above, since while conveyed, the medium M is guided in the direction closer to the side guide 24 using the inclination of the steering roller 22, the medium M is conveyed with its movement in the width direction stopped by the side guide 24. Thereby, skew running, meandering running and the like of the medium M is inhibited.

Eventually, the medium M conveyed to the feed roller 23 is supplied from the feed roller 23 to the cutter 25. Thereafter, the belt-shaped medium M is repeatedly cut by the cutter 25. Thus, sheet-shaped media M are obtained. These sheet-shaped media M are supplied, for example, to the external apparatus such as the image forming apparatus, as discussed above.

(Movement Operation of Feeding-out Core)

Next, movements of the feeding-out core 12 is explained below.

During the above-discussed conveyance operation of the conveying apparatus, the feeding-out core 12 performs the movement operation depending on the necessity. The principle for the movement of the feeding-out core 12 is as follows.

While the medium M is being drawn out from the feeding-out unit 10 to the conveying unit 20, load is applied to the rotation of the driving shaft 11 using the torque limiter 38 provided to the support unit 30. The load applied to the driving shaft 11 from the torque limiter 38 is, for example, load in a direction reverse to the rotation direction of the driving shaft 11, so-called reversely rotational load. Therefore, a part of medium M between the feeding-out unit 10 and the conveying unit 20 has a tension.

Thus, in a case where the outer diameter of the roll R is large, for example, a force (a drawing-out force F1) for drawing the medium M out of the roll R is needed to feed out the medium M from the feeding-out unit 10 to the conveying unit 20, as illustrated in FIGS. 15 and 16.

In this case, due to the above-discussed difference between the tensile forces F2, F3, a force (a movement force F4) that tries to move the medium M in the direction closer to the side guide 24 is generated.

On the other hand, as the outer diameter of the roll R becomes smaller while the medium M is being continuously fed out from the feeding-out unit 10 to the conveying unit 20, a force (a drawing-out force F5) for drawing the medium M out of the roll R becomes lager than the above-mentioned drawing-out force F1, for example, due to the reversely rotational load applied from the torque limiter 38, as illustrated in FIGS. 17 and 18.

In this case, due to the drawing-out force F5 larger than the drawing-out force F1, a tensile force F6 on the medium M on the second side far from the side guide 24 becomes larger than the tensile force F2, and a tensile force F7 on the medium M on the first side near the side guide 24 becomes larger than the tensile force F3. Accordingly, a force (a movement force F8) that tries to move the medium M in the direction closer to the side guide 24 becomes larger than the above-mentioned movement force F4.

In other words, the difference between the tensile forces produced on the conveyed medium M is larger in the case where the outer diameter of the roll R is small than in the case where the outer diameter of the roll R is large. Thus, the force (movement force) that tries to move the medium M closer to the side guide 24 is larger in the case where the outer diameter of the roll R is small than in the case where the outer diameter of the roll R is large. This movement force becomes gradually larger as the outer diameter of the roll R becomes smaller. Accordingly, as the outer diameter of the roller R becomes smaller, the medium M becomes easier to guide in the direction closer to the side guide 24.

If due to the above-discussed large difference between the tensile forces, the medium M is excessively guided in the direction closer to the side guide 24, the medium M tries to continuously move closer to the side guide 24 even after coming into contact with the guide surface 24M of the side guide 24. As a result, depending on the magnitude of the movement force F8, the medium M bends in its part near the end portion due to its collision against the side guide 24, and the medium M is accordingly damaged. The damage on the medium M is a factor of a phenomenon in which the conveying apparatus cannot normally convey the medium M (a so-called conveyance jam). It is needless to say that in the case where the medium M is supplied from the conveying apparatus to the image forming apparatus, the damage on the medium M decreases the quality of an image formed by the image forming apparatus.

For the purpose of inhibiting the damage on the medium M, the feeding-out core 12 performs the movement operation during the conveyance operation of the conveying apparatus.

To put it specifically, since as illustrated in FIGS. 8 and 9, the driving shaft 11 is inserted through the bearing portion12K provided to the feeding-out core 12, the feeding-out core 12 is basically movable along the driving shaft 11 in the width direction.

Since, however, the friction member 17 fixed to the feeding-out core 12 is pressed against the driving shaft 11, the movement of the feeding-out core 12 is restricted using the friction member 17. In other words, the friction force produced between the contact surfaces of the driving shaft 11 and the friction member 17 makes the feeding-out core 12 less likely to move along the driving shaft 11 in the width direction.

To put it specifically, in the case where the outer diameter of the roll R is still large (FIGS. 15 and 16), the drawing-out force F1 is smaller, and the difference between the tensile forces F2, F3 is also smaller. In this case, the force that tries to move the feeding-out core 12 along the driving shaft 11 from the first side near the side guide 24 toward the second side far from the side guide 24 is smaller than the friction force produced between the friction surfaces of the driving shaft 11 and the friction member 17.

Thereby, with the feeding-out core 12 staying without moving, the medium M is conveyed from the feeding-out unit 10 to the conveying unit 20, and the medium M is guided in the direction closer to the side guide 24 using the inclination of the steering roller 22. Thus, the medium M is conveyed while: restricting the movement of the medium M in the width direction using the side guide 24; and inhibiting the medium M from being damaged due to the collision of the medium M against the side guide 24.

On the other hand, as the outer diameter of the roll R becomes smaller (FIGS. 17 and 18), the drawing-out force F5 becomes larger, and the difference between the tensile forces F6, F7 becomes larger. In this case, the force that tries to move the feeding-out core 12 along the driving shaft 11 from the first side near the side guide 24 toward the second side far from the side guide 24 becomes larger than the friction force produced between the friction surfaces of the driving shaft 11 and the friction member 17.

Thereby, while the feeding-out core 12 spontaneously moves along the driving shaft 11 from the first side near the side guide 24 toward the second side far from the side guide 24 using the difference between the tensile forces F6, F7, the medium M is conveyed from the feeding-out unit 10 to the conveying unit 20. In this case, as the outer diameter of the roll R becomes smaller, the force that tries to move the feeding-out core 12 along the driving shaft 11 from the first side near the side guide 24 toward the second side far from the side guide 24 becomes gradually larger. Accordingly, the feeding-out core 12 gradually moves. Furthermore, the medium M is guided in the direction closer to the side guide 24 using the inclination of the steering roller 22. In this case, using the above-discussed movement of the feeding-out core 12, the medium M is inhibited from being excessively guided in the direction closer to the side guide 24. Thus, like in the case where the outer diameter of the roller R is still large, in the case where the outer diameter of the roller R is smaller, the medium M is conveyed while: restricting the movement of the medium M in the width direction using the side guide 24; and inhibiting the medium M from being damaged due to collision of the medium M against the side guide 24.

In this case, particularly since the driving shaft 11 is provided with the flat surface 11M, the use of the friction member 17 makes it easier to restrict the movement of the feeding-out core 12 in the width direction.

To put it in detail, if the driving shaft 11 were not provided with the flat surface 11M, the area of contact between the driving shaft 11 and the friction member 17 would be smaller when the friction member 17 is pressed against the driving shaft 11. In this case, the friction force produced between the contact surfaces of the driving shaft 11 and the friction member 17 would be smaller as well. Accordingly, it would be difficult to restrict the movement of the feeding-out core 12 using the friction member 17.

In contrast to this, in the case where the driving shaft 11 is provided with the flat surface 11M, the area of contact between the driving shaft 11 and the friction member 17 becomes larger when the friction member 17 is pressed against the driving shaft 11 (the flat surface 11M). In this case, since the friction force produced between the driving shaft 11 and the friction member 17 becomes larger, it is easier to restrict the movement of the feeding-out core 12 using the friction member 17.

(1-6. Operation and Effects)

In the conveying apparatus, the steering roller 22 placed on the conveyance route of the medium M inclines such that: the conveyed distance of the medium M becomes shorter towards the first side of the conveyance route near the side guide 24; and the conveyed distance of the medium M becomes longer toward the second side of the conveyance route far from the side guide 24. The feeding-out core 12 holding the roll of medium M (the roll R) continuously feeds out the medium M while rotating in response to the rotation of the driving shaft 11, and moves along the driving shaft 11 in the state where the friction member 17 fixed to the feeding-out core 12 is pressed against the driving shaft 11.

In this case, as discussed above, using the friction force produced between the contact surfaces of the driving shaft 11 and the friction member 17, the feeding-out core 12 spontaneously moves gradually from the first side of near the side guide 24 toward the second side far from the side guide 24 as the outer diameter of the roll R becomes smaller. Thereby, like in the case where the outer diameter of the roll R is still large (FIGS. 15 and 16), in the case where the outer diameter of the roller R is smaller (FIGS. 17 and 18), the medium M is conveyed while: restricting the movement of the medium M in the width direction using the side guide 24; and inhibiting the medium M from being damaged due to collision of the medium M against the side guide 24. Thus, regardless of the outer diameter of the roll R, the medium M is conveyed normally and stably while: restricting the movement of the medium M in the width direction; and inhibiting damage on the medium M. For this reason, excellent conveyance performance can be obtained.

Particularly, as the outer diameter of the roll R becomes smaller, the feeding-out core 12 spontaneously moves more using the difference between the tensile forces produced on the medium M, as discussed above. In this case, the feeding-out core 12 can move depending on the necessity without using a specialized movement mechanism or the like that moves the tension sensor for detecting the tensile forces on the medium M, and the feeding-out core 12. Accordingly, higher effects can be obtained because the feeding-out core 12 can easily move while avoiding a complication to the configuration of the conveying apparatus and a cost increase.

Furthermore, since the driving shaft 11 is provided with the flat surface 11M and the friction member 17 is pressed against the flat surface 11M, the contact surfaces of the driving shaft 11 and the friction member 17 is larger than otherwise, and the friction force produced between the contact surfaces is accordingly larger. Thus, the movement of the feeding-out core 12 in the width direction is more easily restricted using the friction member 17. Accordingly, higher effects can be obtained.

2. Modified Examples

The configuration of the above-discussed conveying apparatus can be modified depending on the necessity.

Modified Example 1

To put it specifically, in the case illustrated in FIGS. 8 and 9, for example, the pressing force of the friction member 17 against the driving shaft 11 is substantially constant. Nevertheless, the pressing force of the friction member 17 against the driving shaft 11 may be variable. In this case, ease in the movement of the feeding-out core 12 can be adjusted in response to the pressing force. Thus, higher effects can be obtained.

For the purpose of making the pressing force variable, for example, the configuration of the feeding-out core 12 may be changed as discussed below.

Figure 19:
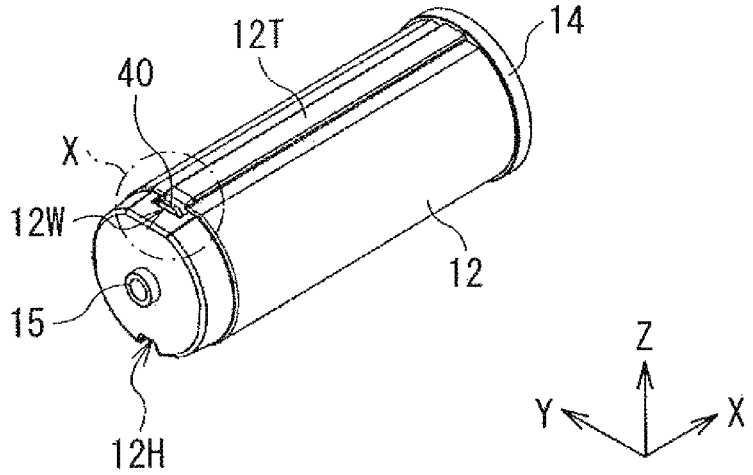
FIG. 19 is a perspective view of a modified example of the feeding-out core.
Figure 20:
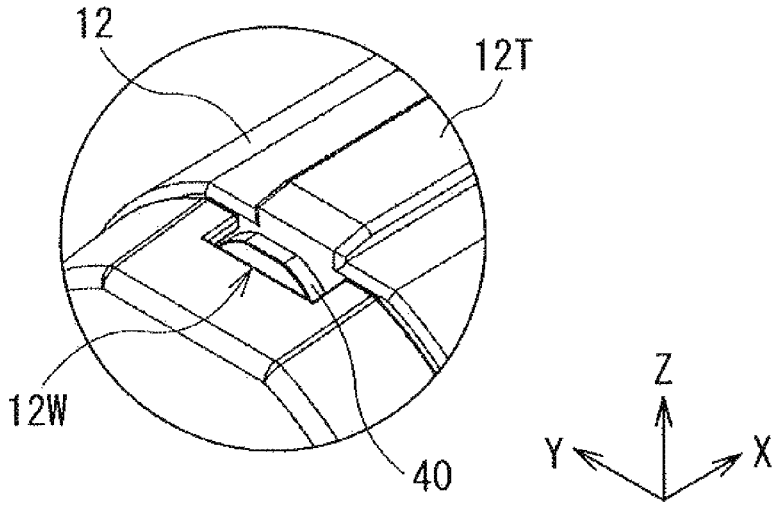
FIG. 20 is a magnified perspective view of a configuration of a part X in FIG. 19.

For the purpose of explaining a modified example of the configuration of the feeding-out core 12, FIG. 19 illustrates a perspective configuration of the feeding-out core 12, which corresponds to FIG. 7. FIG. 20 is a magnified view of a part X of the perspective configuration of the feeding-out core 12 illustrated in FIG. 19.

Figure 21:
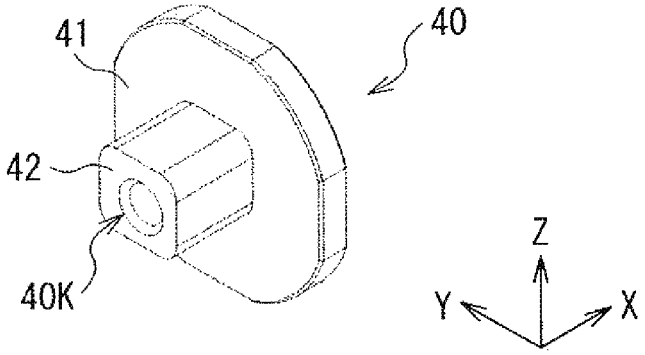
FIG. 21 is a perspective view illustrating a configuration of an adjustment dial.
Figure 22:
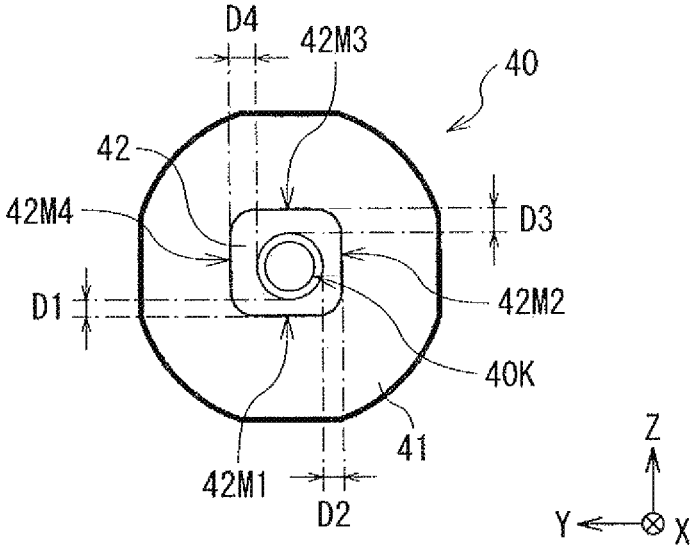
FIG. 22 is a plan (front) view of the adjustment dial illustrated in FIG. 21.

FIGS. 21 and 22 each illustrate a configuration of an adjustment dial 40. Specifically, FIG. 21 illustrates a perspective configuration of the adjustment dial 40, and FIG. 22 illustrates a plan (front) configuration of the adjustment dial 40.

Figure 23:
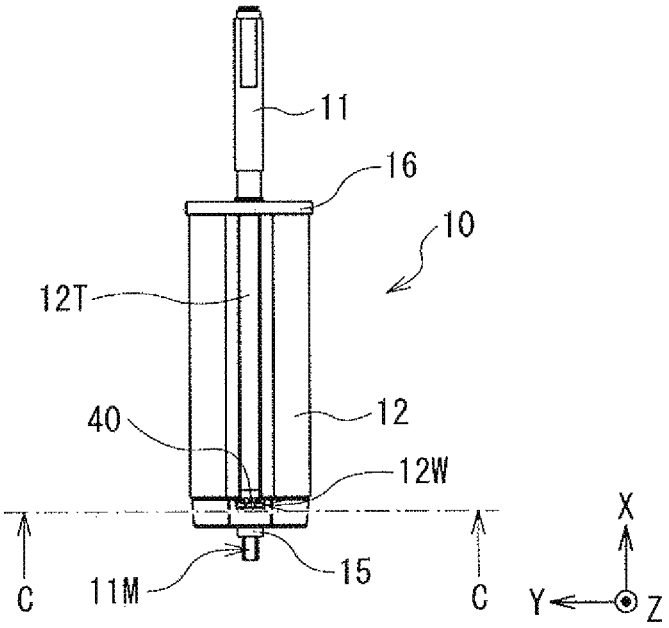
FIG. 23 is a plan (top) view of the feeding-out unit that includes a feeding-out core according to the modified example.
Figure 24:
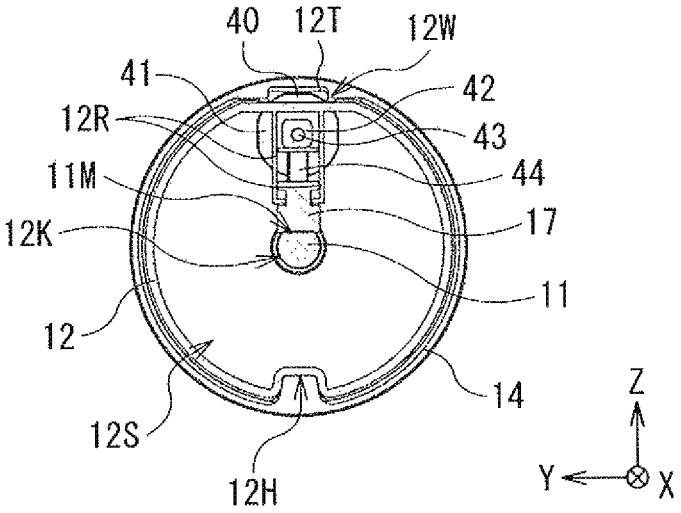
FIG. 24 is a cross-sectional view of the feeding-out unit taken along the C-C line in FIG. 23.

FIG. 23 illustrates a plan (top) configuration of the feeding-out unit 10 including the modified example of the feeding-out core 12. FIG. 24 illustrates a cross-sectional configuration of the feeding-out unit 10 taken along the C-C line in the FIG. 23. Incidentally, FIGS. 23 and 24 each illustrate the configuration of the feeding-out unit 10 with the cap 13 detached from the feeding-out unit 10.

The pressing force-variable feeding-out core 12 has the same configuration of the feeding-out core 12 illustrated in FIG. 7, for example, except for what are discussed below.

To put it specifically, as illustrated in FIGS. 19 to 24, the feeding-out core 12 further includes, for example, the adjustment dial 40, a shaft 43 and an elastic member 44.

It should be noted that: the adjustment dial 40 corresponds to a "rotation plate" of the present disclosure; and the shaft 43 corresponds to a "rotation shaft" of the present disclosure that rotates the "rotation plate."

The adjustment dial 40 is a plate-shaped member that is rotated to change the pressing force, and is placed in the space 12S inside the feeding-out core 12. As illustrated in FIGS. 19 and 20, the feeding-out core 12 is provided, for example, with an adjustment window 12W. A part of the adjustment dial 40 sticks out from the adjustment window 12W, for example. For this reason, the user of the conveying apparatus can manipulate the adjustment dial 40 by touching the part of the adjustment dial 40 that sticks out from the adjustment window 12W.

As illustrated in FIGS. 21 and 22, the adjustment dial 40 includes, for example, an adjustment plate 41, and a projecting adjustor 42 connected to the adjustment plate 41.

The adjustment plate 41 mainly supports the adjustor 42, and rotates the adjustor 42 in response to its own rotation. The plan shape of the adjustment plate 41 is not limited to a particular one. An example of the plan shape is a rectangle or the like whose four corner portions are round.

The adjustor 42 mainly changes the pressing force of the fiction member 17 against the driving shaft 11. The three-dimensional shape of the adjustor 42 is not limited to a particular one. An example of the three-dimensional shape is a substantial cube in which four corner portions extending in the projection direction are round. The adjustor 42 is placed, for example, substantially at the center of one surface of the adjustment plate 41.

It should be noted that: the adjustment dial 40 is provided, for example, with a bearing portion 40K that penetrates through the adjustment plate 41 and the adjustor 42; and the shaft 43, for example, is inserted through the bearing portion 40K. Thus, the adjustment dial 40 is rotatable around the shaft 43, for example.

In this adjustment dial 40, as illustrated in FIG. 22, for example, the bearing portion 40K is not placed at the center of the adjustor 42, but is placed at a location offset from the center of the adjustor 42. In addition, because of the above-mentioned three-dimensional shape, the adjustor 42 is provided, for example, with four adjustment surfaces 42M1, 42M2, 42M3, 42M4 that extend in a direction intersecting the one surface of the adjustment plate 41.

Thus, the distances from the bearing portion 40K to the adjustment surfaces 42M1, 42M2, 42M3, 42M4 are different from one another. To put it specifically, the distance D1 from the bearing portion 40K to the adjustment surface 42M1, the distance D2 from the bearing portion 40K to the adjustment surface 42M2, the distance D3 from the bearing portion 40K to the adjustment surface 42M3, and the distance D4 from the bearing portion 40K to the adjustment surface 42M4 satisfy a relationship represented by D4>D3>D2>D1, for example.

In the feeding-out core 12, as illustrated FIGS. 23 and 24, for example, the driving shaft 11 is inserted though the bearing portion 12K provided to the feeding-out core 12, and the friction member 17 is pressed against the flat surface 11M provided to the driving shaft 11.

The shaft 43 is mainly a shaft around which to rotate the adjustment dial 40. The shaft 43 is placed, for example, facing the driving shaft 11 with the friction member 17 interposed in between. Thus, the adjustment dial 40 is placed, for example, facing the driving shaft 11 with the friction member 17 interposed in between.

The elastic member 44 mainly elastically changes its shape in a direction in which the adjustment dial 40 and the friction member 17 face each other, and thereby changes the pressing force of the friction member 17 against the driving shaft 11 in response to rotation angles of the adjustment dial 40. The elastic member 44 is placed, for example, between the adjustor 42 of the adjustment dial 40 and the friction member 17. The type of the elastic member 44 is not limited to a particular one as long as the elastic member 44 is made of a material that allows the elastic member 44 to, as discussed above, elastically change its shape in the direction in which the adjustment dial 40 and the friction member 17 face each other. An example of the type of the elastic member 44 is a spring.

In the feeding-out core 12, as clear from FIGS. 22 and 24, for example, the adjustment dial 40 (the adjustor 42) can rotates around the shaft 43 while pressed against the friction member 17 with the elastic member 44 in between. In this case, due to a change in the distance from D1, D2, D3 to D4 in response to rotation angles of the adjustment dial 40, the pressing force of the adjustor 42 against the elastic member 44 changes, and the pressing force of the friction member 17 against the driving shaft 11 accordingly changes.

To put it specifically, in a case where the adjustment dial 40 is rotated in a way that the adjustment surface 42M1 is pressed against the elastic member 44, the distance D1 becomes smaller, and the pressing force of the friction member 17 against the driving shaft 11 accordingly becomes smaller. On the other hand, in a case where the adjustment dial 40 is rotated in a way that the adjustment surface 42M4 is pressed against the elastic member 44, the distance D4 becomes larger, and the pressing force of the friction member 17 against the driving shaft 11 accordingly becomes larger. The pressing force of the friction member 17 against the driving shaft 11 changes in response to rotation angles of the adjustment dial 40, that is to say, depending on which of the adjustment surfaces 42M1 to 42M4 is pressed against the elastic member 44.

Thereby, in the feeding-out core 12 including the adjustment dial 40, the pressing force of the friction member 17 against the driving shaft 11 changes in response to rotation angles of the adjustment dial 40. Thus, the ease in the movement of the feeding-out core 12 is adjusted using the adjustment dial 40. Accordingly, higher effects can be obtained.

Particularly, since the elastic member 44 is interposed between the adjustment dial 40 (the adjustor 42) and the friction member 17, the pressing force efficiently changes using the elastic shape change of the elastic member 44. Thus, the ease in the movement of the feeding-out core 12 is easily adjusted using the adjustment dial 40. Accordingly, much higher effects can be obtained.

Modified Example 2

Furthermore, although as illustrated in FIGS. 5, 9 and so on, the driving shaft 11 is provided with the flat surface 11M, the driving shaft 11 does not have to be provided with the flat surface 11M. In this case, too, the same effects can be obtained because: the friction member 17 is pressed against the driving shaft 11; and the movement of the feeding-out core 12 is thereby restricted using the friction force produced between the contact surfaces of the driving shaft 11 and the friction member.

It should be noted that it is desirable that, as discussed above, the driving shaft 11 be provided with the flat surface 11M in order to increase the friction force produced between the contact surfaces of the driving shaft 11 and the friction member.

Modified Example 3

In the embodiment, for example, the driving shaft 11 is provided with one flat surface 11M, and one friction member 17 that is pressed against the flat surface 11M is used. However, the driving shaft 11 may be provided with two or more flat surfaces 11M, and two or more friction members 17 that are respectively pressed against the two or more flat surfaces 11M may be used. In this case, too, the same effects can be obtained.

Modified Example 4

Furthermore, as illustrated in FIG. 24, for example, the elastic member 44 is interposed between the adjustment dial 40 (the adjustor 42) and the friction member 17, as well as the adjustment dial 40 is thereby indirectly pressed against the friction member 17. However, the elastic member 44 does not have to be provided. In this case, too, the same effects can be obtained because: the adjustor 42 is directly pressed against the elastic member 44; and the pressing force thereby changes in response to rotation angles of the adjustment dial 40.

It should be noted that it is desirable that, as discussed above, the elastic member 44 be provided between the adjustment dial 40 and the friction member 17 in order to efficiently change the pressing force in response to rotation angles of the adjustment dial 40.

EXAMPLES

Detailed descriptions are provided for examples according to the present disclosure.

Experimental Example 1

Conveyance performance of the conveying apparatus discussed using FIGS. 1 to 13 is examined by making the conveying apparatus convey the medium M.

In the conveying apparatus according to the present invention, as discussed above, the difference between the tensile forces occurs on the medium M due to the inclination of the steering roller 22, and the feeding-out core 12, therefore, can spontaneously move gradually from the first side of the conveyance route near the side guide 24 toward the second side of the conveyance route far from the side guide 24 as the outer diameter of the roll R becomes smaller.

The conveyance performance is examined by conducting a conveyance test using a roll of medium M (with an 85-mm roll diameter). A label sheet (with a 130-mm width and a 140-mm thickness) extending in the conveyance direction is used as the medium M. This label sheet is a label sheet in which a fine quality paper including label portions (with a 126-mm width and a 127-mm length) is bonded to a substrate (with a 130-mm width) using an adhesive layer. The label portions are arranged in the conveyance direction, and a gap between each adjacent two of the label portions is at 3 mm. In the conveyance test, the medium M is continuously conveyed (at a conveyance speed of 4 ips (=approximately 102 mm/second) while drawing a black straight line on the surface of the medium M using a printer between the feed roller 23 and the cutter 25 (see FIG. 14). Furthermore, sheet-shaped media M are obtained by continuously cutting the medium M (into 1300-mm cut lengths (=lengths each of 10 label portions)) using the cutter 25. The straight line is a straight line extending in the conveyance direction. The position at which to draw the straight line is a position that is 7.41 mm (a target value) away from the guide surface 24M in a direction farther from the side guide 24.

The conveyance test is continued until the number of sheet-shaped media M reaches 30. Thereafter, for each of the 30 sheet-shaped media M, the distance from the edge of the medium M on the first side near the side guide 24 to the straight line (referred to as an "end portion distance") is measured using a loupe. A result illustrated in FIG. 25 is obtained.

Figure 25:
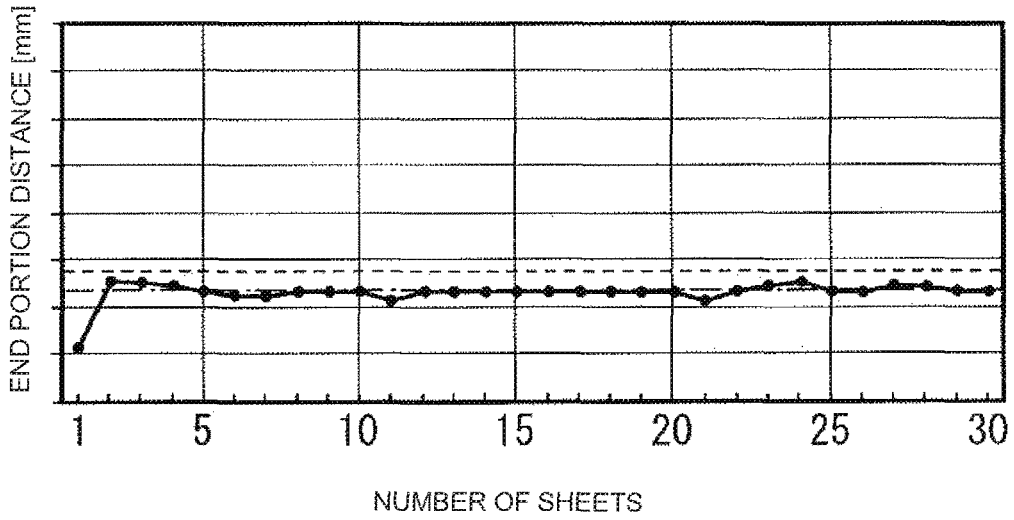
FIG. 25 is a diagram illustrating a result of a conveyance test using a conveying apparatus according to Experimental Example 1.

FIG. 25 illustrates the result of the conveyance test on the conveying apparatus of Experimental Example 1. In FIG. 25, the horizontal axis represents the number of sheet-shaped media M (unit: sheet), and the vertical axis represents the end portion distance (unit: millimeter). Incidentally, the dashed line in FIG. 25 represents the target (proper) value of the end portion distance, and the chain line in FIG. 25 represents an average of the actual measurement values of the end portion distance.

Experimental Example 2

Figure 26:
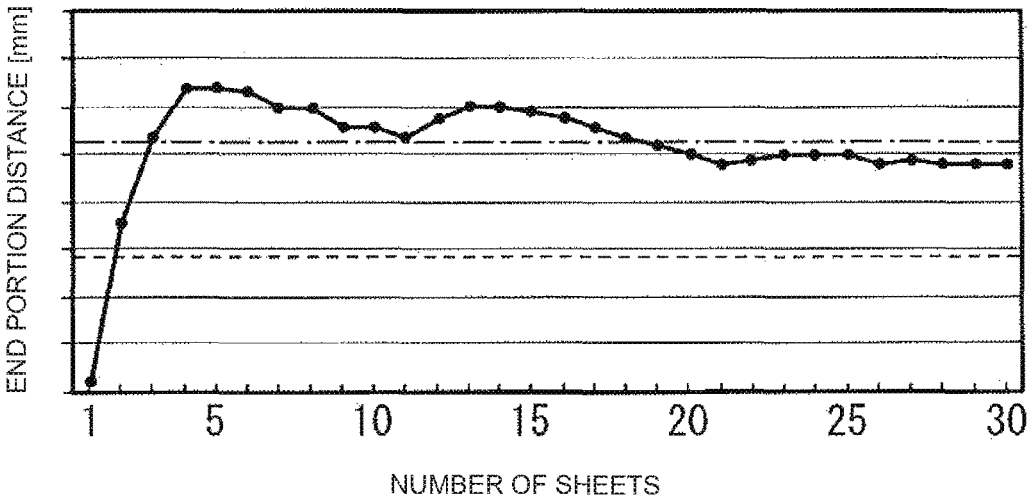
FIG. 26 is a diagram illustrating a result of a conveyance test using a conveying apparatus according to Experimental Example 2.

For a comparison purpose, the conveyance performance of the conveying apparatus is examined using the same procedure as in Experimental Example 1, but except that the conveying apparatus including an unmovable feeding-out core 12 is used. Thereby, a result illustrated in FIG. 26 is obtained. FIG. 26 illustrates the result of the conveyance test on the conveying apparatus of Experimental Example 2, and corresponds to FIG. 25. In this conveying apparatus, the feeding-out core 12 is unmovable since the feeding-out core 12 is fixed to the driving shaft 11.

As illustrated in FIGS. 25 and 26, the conveyance performance is widely different depending on whether the feeding-out core 12 is movable or unmovable.

To put it specifically, in the case where the feeding-out core 12 is unmovable (Experimental Example 2), no excellent conveyance performance can be obtained as illustrated in FIG. 26. In this case, as the outer diameter of the roll R becomes smaller (as the number of sheet-shaped media M becomes larger), the medium M more bends at a part near its end portion due to its collision against the side guide 24. Thus, the end portion distance becomes larger, and accordingly deviates from the target value to a large extent. Furthermore, because the widthwise position of the medium M fluctuates while the medium M is being conveyed, the end portion distance vary depending on the number of sheet-shaped media M.

It should be noted that 0.57 is the standard deviation a of the end portion distance in the case where the feeding-out core 12 is unmovable.

In contrast to this, in the case where the feeding-out core 12 is movable (Experimental Example 1), the excellent conveyance performance is obtained as illustrated in FIG. 25. In this case, even though the outer diameter of the roll R becomes smaller, the medium M is less likely to collide against the side guide 24, and accordingly less likely to bend. Thus, the end portion distance is substantially equal to the target value. In addition, the widthwise position of the medium M is less likely to fluctuate while the medium M is being conveyed. Thus, the end portion distance is substantially constant regardless of the number of media M.

In this case, particularly, the feeding-out core 12 moves gradually, but not suddenly, as the outer diameter of the roll R becomes smaller. Thus, even though the feeding-out core 12 moves, the end portion distance substantially does not change, and is substantially constant.

It should be noted that 0.12 is the standard deviation a of the end portion distance in the case where the feeding-out core 12 is movable.

These results show that the medium M is conveyed normally and stably in the case where: the steering roller 22 inclines; the feeding-out core 12 holding the roll R continuously feeds out the medium M while rotating in response to the rotation of the driving shaft 11; and the feeding-out core 12 moves along the driving shaft 11 with the friction member 17 pressed against the driving shaft 11. The conveying apparatus can obtain the excellent conveyance performance.

Although the present invention has been described using the embodiment, the present invention is not limited to the aspect that is discussed as the embodiment, and may be variously modified.

To put it specifically, for example, the external apparatus to which the medium is supplied from the conveying apparatus of the embodiment is not limited to the image forming apparatus. This external apparatus may be, for example, a winding apparatus and a slitter, in addition to the image forming apparatus.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A conveying apparatus comprising:

a shaft member extending in a first direction and rotatable about a rotation axis parallel with the first direction;

a feeding-out member slidably supported on the shaft member in the first direction and retaining a roll of medium, and configured to rotate in a medium conveyance direction with rotation of the shaft member while being movable in the first direction along the shaft member;

a conveyance member configured to convey the medium by drawing the medium from the feeding-out member along a medium conveyance route;

a load applying member that applies a load on the feeding-out member in a direction opposed to the medium conveyance direction;

a guide member provided between the feeding-out member and the conveyance member in the second direction and at one end portion of the medium conveyance route in the first direction, and configured to restrict movement of the medium in the first direction; and an inclination member inclined with respect to the first direction and in contact with the medium between the feeding-out member and the conveyance member in the medium conveyance route, thereby making a conveyed distance of the medium shorter at a first side of the medium conveyance route near the guide member than at a second side of the medium conveyance route far from the guide member.

2. The conveying apparatus according to claim 1, wherein the feeding-out member moves from the first side of the medium conveyance route near the guide member toward the second side of the medium conveyance route far from the guide member due to a difference between a tensile force generated on the medium on the first side and a tensile force generated on the medium on the second side.

3. The conveying apparatus according to claim 1, wherein the inclination member is provided at a location lower than the guide member, and inclined with respect to the first direction such that the inclination member is higher on the first side of the medium conveyance route near the guide member than on the second side of the medium conveyance route far from the guide member.

4. The conveying apparatus according to claim 1, further comprising a friction member fixed to the roll retainer and pressed against the shaft member.

5. The conveying apparatus according to claim 4, wherein the shaft member includes a flat surface extending in the first direction, and the friction member is pressed against the flat surface.

6. The conveying apparatus according to claim 4, further comprising a rotation plate provided facing the shaft member with the friction member interposed in between, and configured to rotate about a rotation shaft while pressed against the friction member to change a distance between the rotation shaft and the friction member response to a rotation angle of the rotation plate.

7. The conveying apparatus according to claim 6, further comprising an elastic member provided between the rotation plate and the friction member, and elastically deformable in a direction in which the rotation plate and the friction member face each other.

* * * * *